US008051532B1

(12) United States Patent
Griffith et al.

(10) Patent No.: US 8,051,532 B1
(45) Date of Patent: Nov. 8, 2011

(54) DUST CUP LATCH MECHANISM FOR CYCLONE SEPARATOR VACUUM

(76) Inventors: Aaron P. Griffith, Grand Rapids, MI (US); Eric R. Metzger, White Cloud, MI (US)

( * ) Notice: Subject to any disclaimer, the term of this patent is extended or adjusted under 35 U.S.C. 154(b) by 636 days.

(21) Appl. No.: 12/255,948

(22) Filed: Oct. 22, 2008

Related U.S. Application Data

(63) Continuation-in-part of application No. 12/121,026, filed on May 15, 2008.

(60) Provisional application No. 60/981,672, filed on Oct. 22, 2007, provisional application No. 60/938,583, filed on May 17, 2007.

(51) Int. Cl.
*A47L 9/16* (2006.01)

(52) U.S. Cl. ..... 15/353; 15/352; 55/337; 55/429; 55/DIG. 3

(58) Field of Classification Search ..... 15/352, 15/353; 55/337, 429, DIG. 3; *A47L 9/16*
See application file for complete search history.

(56) References Cited

U.S. PATENT DOCUMENTS

| | | | |
|---|---|---|---|
| 6,732,406 | B2 | 5/2004 | Oh |
| 6,735,816 | B2 | 5/2004 | Oh et al. |
| 6,782,584 | B2 | 8/2004 | Choi |
| 6,922,868 | B1 | 8/2005 | Jeong |
| 6,991,667 | B2 | 1/2006 | Yang et al. |
| 7,191,490 | B2 | 3/2007 | Lee et al. |
| 2002/0029436 | A1 | 3/2002 | Hawkins et al. |
| 2008/0000044 | A1 | 1/2008 | Lee |

*Primary Examiner* — David Redding
(74) *Attorney, Agent, or Firm* — McGarry Bair PC

(57) ABSTRACT

A latching mechanism for a dust cup assembly on a bottom exit cyclone-separator vacuum cleaner including a non-rotating sealing conduit member that supports a dust cup assembly above a discharge outlet coupled to a sliding latch member via pin-mounted linkages. The conduit member raises and lowers the dust cup assembly into and out of engagement with the cyclone separator coincident with horizontal sliding movement of the latch member in and out underneath the dust cup to releasably attach and detach the dust cup assembly from the cyclone separator.

11 Claims, 8 Drawing Sheets

DUST CUP LATCH MECHANISM FOR CYCLONE SEPARATOR VACUUM

CROSS-REFERENCE TO RELATED APPLICATIONS

This application claims the benefit of U.S. Provisional Patent Application No. 60/981,672, filed Oct. 22, 2007, and is a continuation-in-part of U.S. patent application Ser. No. 12/121,026, filed May 15, 2008, which claims the benefit of U.S. Provisional Patent Application No. 60/938,583, May 7, 2007, all of which are enclosed herein by reference.

BACKGROUND OF THE INVENTION

1. Field of the Invention

The present invention relates to vacuum cleaners. In one of its aspects, the invention relates to a vacuum cleaner with a dirt cup that is removably mounted to a cyclone separator. In another of its aspects, the invention relates to a vacuum cleaner with an improved latch for removably mounting a dirt cup to a cyclone separator.

2. Description of the Related Art

Upright vacuum cleaners that use cyclone action to separate dust, dirt, and contaminates entrained in the airflow are well known. U.S. Pat. No. 7,191,490 to Lee et al. discloses a top exit cyclone assembly including a soil collection receptacle at a lower portion thereof and having a sliding groove formed on the bottom surface that confronts the floor of an accommodation recess on the handle. A guide member is located at the lower end of the soil collection receptacle, wherein the guide member is formed with a pair of guide projections at opposite sides and an operation lever adapted to move the guide member up and down to raise and lower the soil collection receptacle in sealing relation to the cyclone assembly. The guide member moves up and down as the operation lever is pushed and pulled horizontally relative to the handle.

U.S. Pat. No. 6,732,406 to Oh shows a removable dust cup that slides out from under the cyclone chamber. The dust cup is locked in place and released by a rotating handle that directly engages a slanted, spiraling recess on the bottom of the dust cup. Rotating the handle in a first direction raises the dust cup toward the bottom of the cyclone chamber, locking the dust cup in place; rotating the handle the opposite direction lowers the dust cup from the cyclone chamber for emptying.

U.S. Pat. No. 6,735,816 to Oh et al. discloses a removable dust cup that is raised and lowered into and out of engagement with the cyclone chamber by a rotating lever. The rotating lever raises and lowers the dust cup through an intermediate, non-rotating locking disc operating against the bottom of the dust container.

U.S. Pat. No. 6,991,667 to Yang et al. discloses a dust cup supported on a coaxial filter case to provide a direct suction path between the motor below it and the cyclone chamber above it. The filter case provides an extra stage of filtration and dust separation for the air exiting the cyclone chamber through the dust cup into the motor housing. The filter case is securely fixed to an annular lever and seal member that surrounds and seals the airflow path from the filter to the motor housing; the dust cup is detachable from the filter case. The annular lever and seal member is mounted to rotate as a unit on a cam structure on the motor housing cover, raising the lever and seal assembly and filter case up and down, and thus raising and lowering the dust cup into and out of engagement with the cyclone chamber.

SUMMARY OF THE INVENTION

According to the invention, a vacuum cleaner comprises a housing with a cyclone separation chamber having an inlet opening and an outlet opening, a dust cup assembly removably mounted beneath the cyclone separation chamber and having a dust cup with an exhaust conduit extending through the dust cup between the cyclone separation outlet opening and a discharge opening in a bottom wall of the dust cup, and a latching mechanism positioned beneath the dust cup assembly for raising the dust cup into engagement with the cyclone separation chamber and for lowering the dust cup from engagement with the cyclone chamber. The latching mechanism comprises a sealing conduit member mounted in the housing beneath the dust cup assembly in fluid communication with the exhaust conduit when the dust cup is in engagement with the cyclone separation chamber and a sliding latch member coupled to the sealing conduit member via at least one linkage member and being movable relative to the housing to raise and lower the sealing conduit member into and out of engagement with the dust cup assembly.

DESCRIPTION OF THE PREFERRED EMBODIMENT

Figure 1:
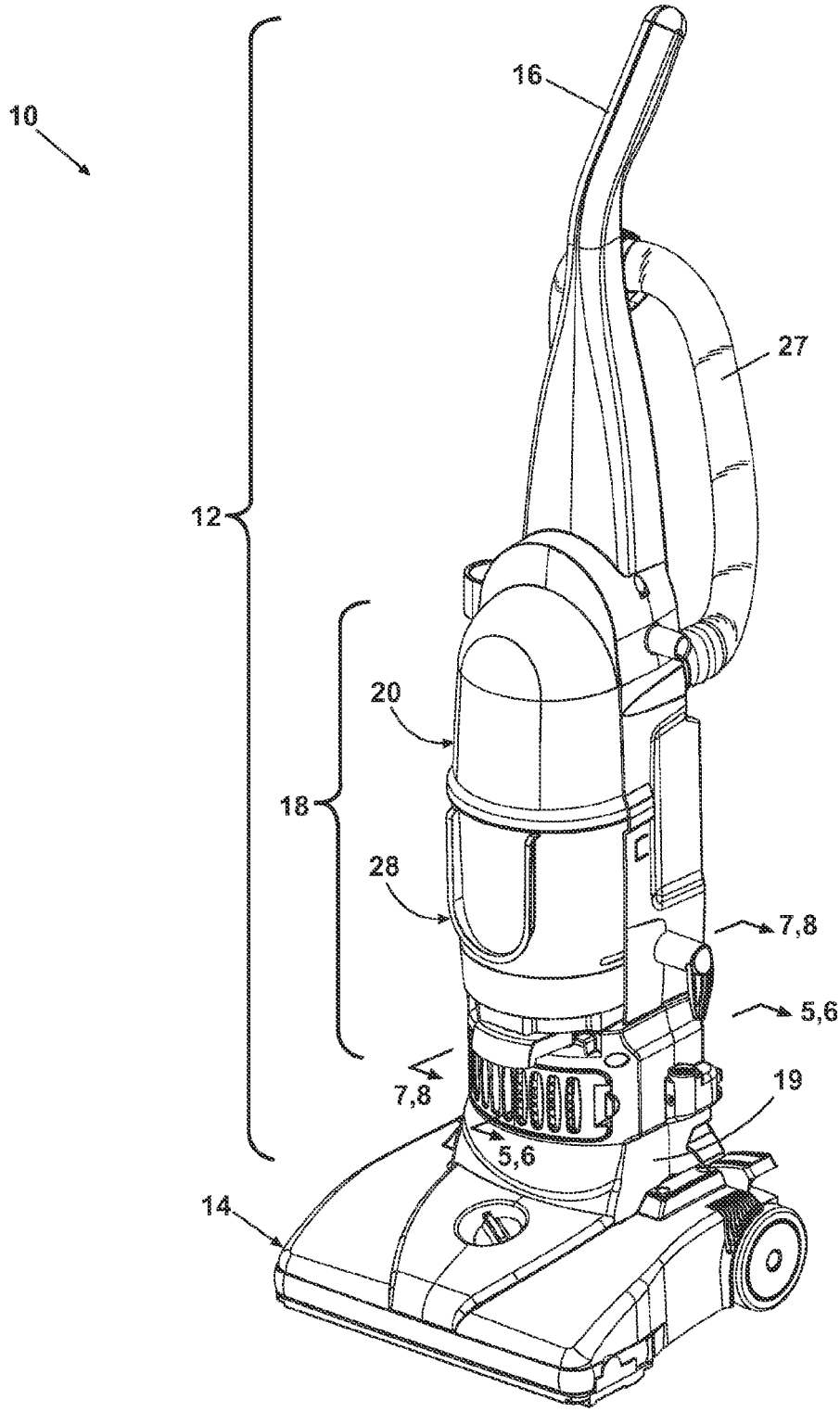
FIG. 1 is a front perspective view of an upright vacuum cleaner with a dust cup assembly and latching mechanism according to the invention.
Figure 2:
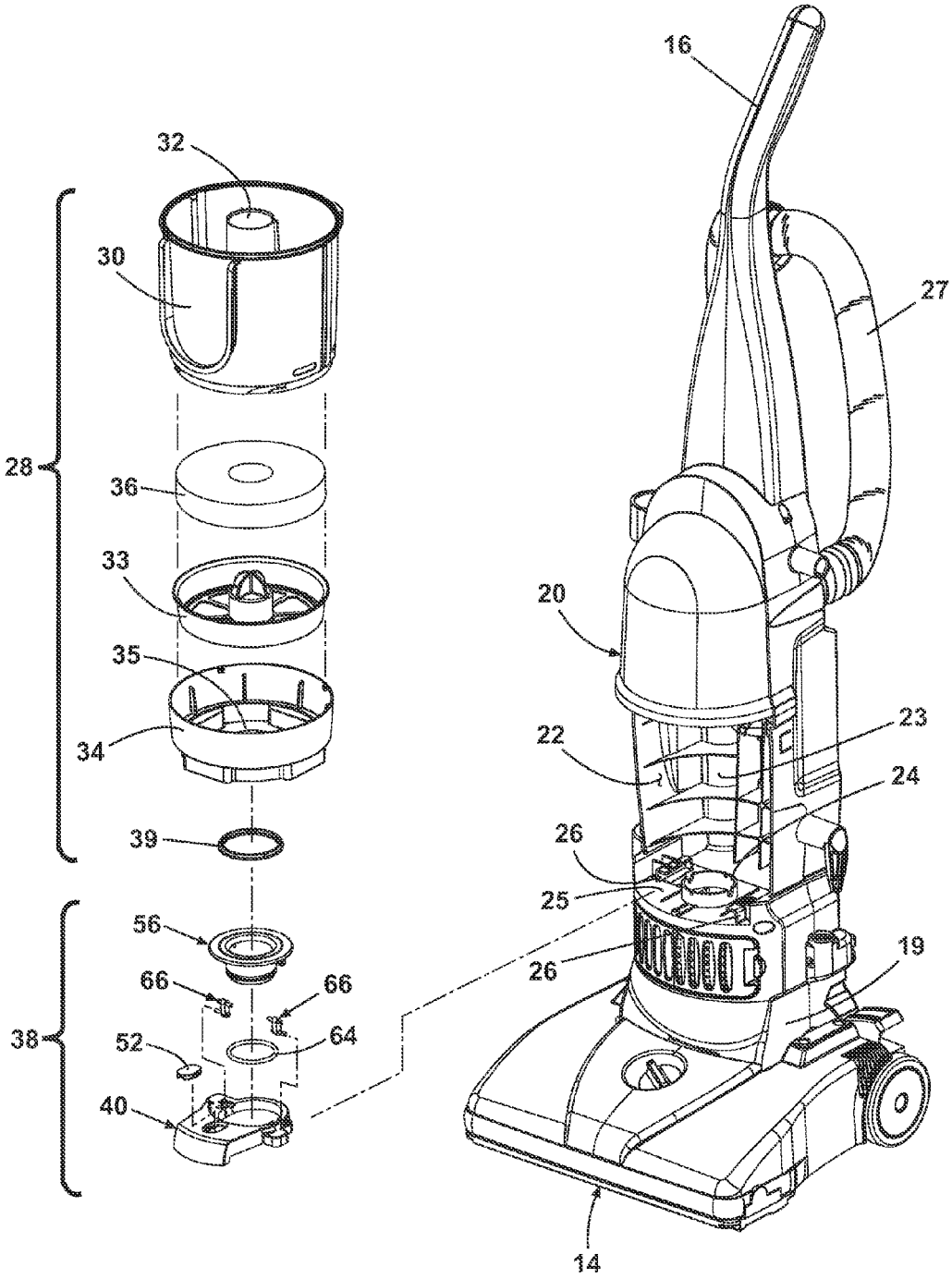
FIG. 2 is an exploded front perspective view of the dust cup assembly and latching mechanism of the vacuum cleaner of FIG. 1.

An upright vacuum cleaner 10 with an improved dust cup latching mechanism 38 according to the invention is shown in FIG. 1. A suitable vacuum cleaner is shown in more detail in International Application No. PCT/US2004/034841, filed Oct. 21, 2004, and U.S. patent application Ser. No. 12/121,026, filed May 15, 2008, both of which are incorporated herein by reference in their entirety. The vacuum cleaner comprises an upright handle assembly 12 pivotally mounted to a conventional foot assembly 14. Referring to FIGS. 1 and 2, the upright handle assembly 12 comprises a handle grip 16, a cyclone separation module 18, a suction motor/fan assembly (not shown) positioned below the cyclone separation module 18 within a lower portion of the upright handle assembly 12 generally indicated by reference numeral 19, and a dust cup recess 22 having a rear wall 23 joined to a bottom wall 25. A suction motor/fan inlet conduit 24 extends through the bottom wall 25 and a pair of opposed receiving channels 26 to retain and guide the improved dust cup latch mechanism 38 are formed on the bottom wall 25 on each side of the suction motor/fan inlet conduit 24. A conventional vacuum hose 27 is also provided on the upright handle assembly 12 and is in fluid communication with the cyclone separation module 18 for above-the-floor cleaning purposes.

The cyclone separation module 18 further comprises a cyclone separator 20 including an airstream inlet and outlet (not shown) and a dust cup assembly 28 located below the cyclone separator 20 and removably received in the dust cup recess 22. The dust cup assembly 28 includes a dust cup 30 with a bottom discharge stand pipe 32, a removable pre-motor filter chamber 34 with a center air passage 35, a removable pre-motor filter 36 that is received within a removable pre-motor filter frame 33, both of which are positioned between the pre-motor filter chamber 34 and the dust cup 30, and a seal 39 for creating an air-tight seal between the pre-motor filter chamber 34 and the dust cup latch mechanism 38. The bottom of the pre-motor filter chamber 34 is preferably formed with a circular recess 31 (FIG. 5) that at least partially houses the seal 39 such that the seal 39 is removable with the dust cup assembly 28. Exhaust air from the cyclone separator 20 flows through the discharge stand pipe 32, passes through the pre-motor filter 36 and into the pre-motor filter chamber 34, and out through the center air passage to the suction motor/fan inlet conduit 24.

Figure 3:
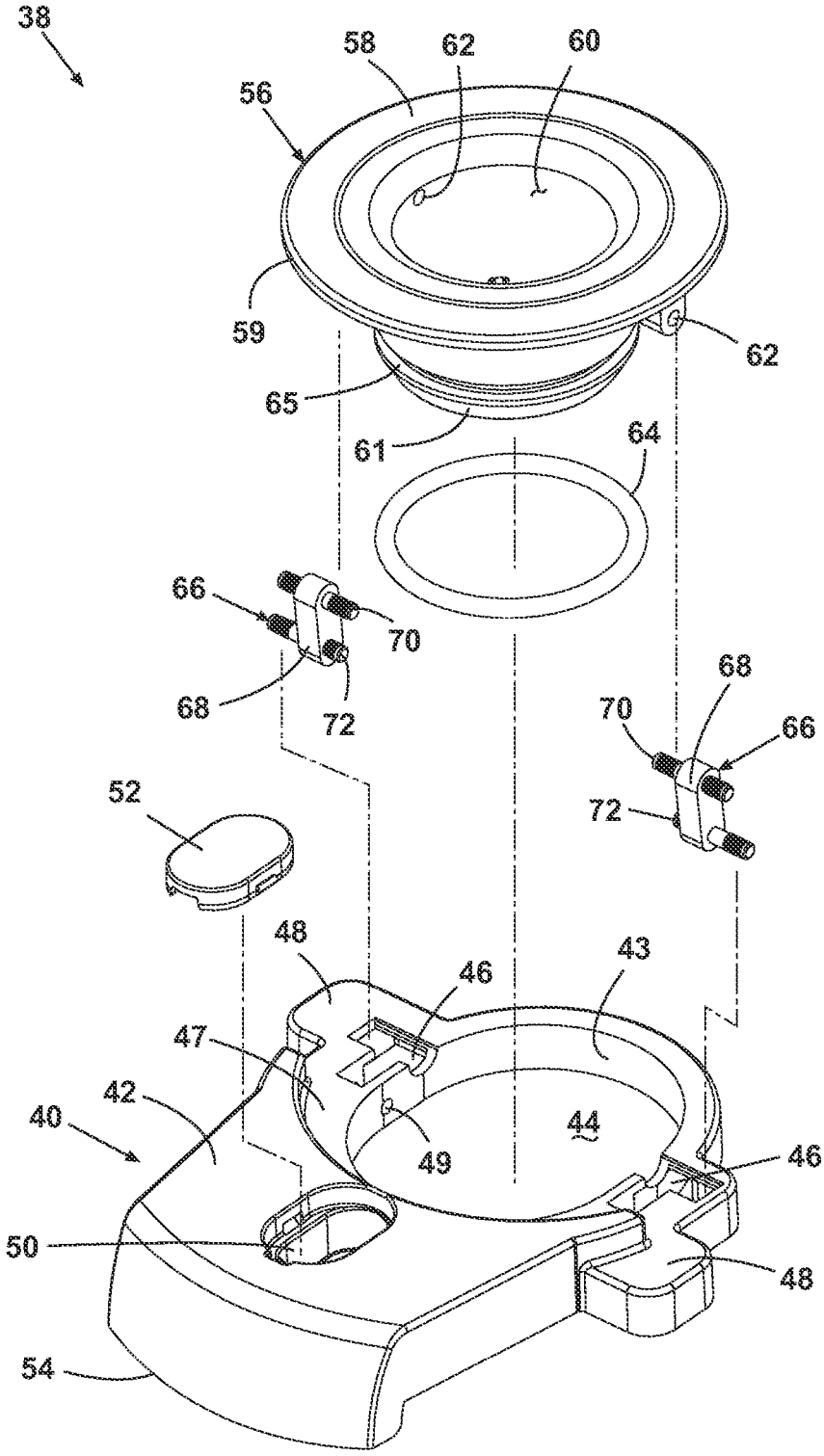
FIG. 3 an exploded perspective view of the latching mechanism of FIG. 2.

Referring now to FIG. 3, the dust cup latch mechanism 38 is comprised of a slide lock latch assembly 40, a sealing conduit member 56, and at least one linkage arm assembly 66 to translate horizontal sliding movement of the slide lock latch assembly 40 into vertical movement of the sealing conduit member 56. The slide lock latch assembly 40 further comprises a slide lock housing 42, an inner peripheral wall 43 defining an elongated aperture 44, a pair of opposed L-shaped recesses 46, an elongated depression 47, a pair of engagement projections 48, at least one mounting boss 49, a securing aperture 50, a corresponding securing aperture cover 52, and a grip 54. The engagement projections 48 are positioned on opposing sides of the slide lock latch housing 42 in offset positions. The slide lock housing 42 is generally rectangular-shaped with the elongated aperture 44 and elongated depression 47 on the top surface accommodating the sealing conduit member 56.

The sealing conduit member 56 further includes a sealing member housing 58 with a flange 59 on the top surface thereof that forms a sealing surface 57, an air passageway 60 extending through the sealing member housing 58, at least one mounting boss 62, and a sealing ring 64 that mates into a C-shaped groove 65 on the outer periphery of a lower portion 61 of the sealing member housing 58. The lower portion 61 can further comprise a grate 63, partially visible in FIGS. 4A and 4B, that extends across the air passageway 60.

Figure 8:
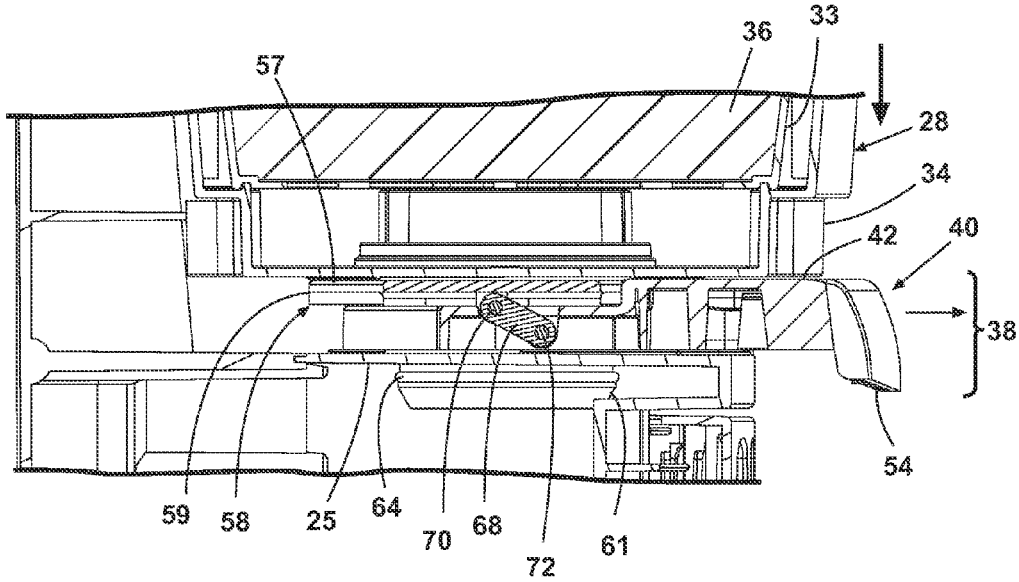
FIG. 8 is a sectional view taken along line 8-8 of FIG. 1 of the latching mechanism in an unlatched position, in which the latch disengaged and lowered.
Figure 7:
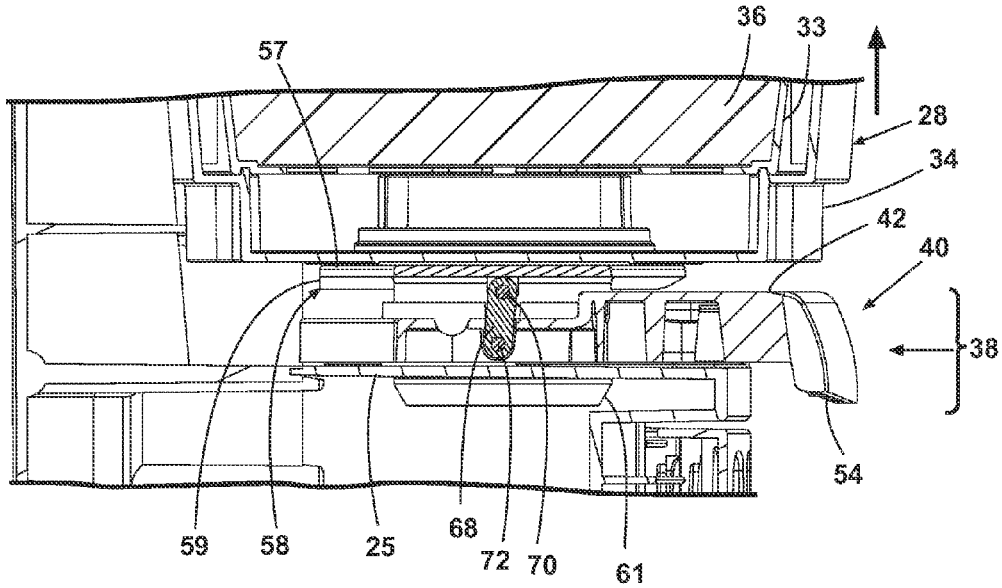
FIG. 7 is a sectional view taken along line 7-7 of FIG. 1 of the latching mechanism in a latched position, in which the latch is engaged and raised.

As illustrated in FIG. 3, two opposed linkage arm assemblies 66 are coupled between the slide lock latch assembly 40 and the sealing conduit member 56. Each of the linkage arm assemblies 66 comprise a link member 68 and two link pins 70, 72 coupled to the link member 68. The link member 68 is an elongated piece, like a rod or lever, with the link pins 70, 72 attached near either end of the link member 68. The pins 72 are pivotally mounted into the mounting bosses 49 of the slide lock housing 42 and the pins 70 are pivotally mounted into one of the mounting bosses 62 of the sealing member housing 58. By this arrangement, translational movement of the slide lock housing 42 moves the sealing member 58 vertically as illustrated in FIGS. 7 and 8. At least one end of the link pins 70, 72 includes a knurled surface that allows a secure press fit into the corresponding components of the slide lock latch assembly 40 and the sealing conduit member 56. The aforementioned link pin 70, 72 and link member 68 arrangement is only one of many potential translating horizontal movement of the slide lock latch assembly 40 into vertical movement of the sealing conduit member 56.

To assemble the dust cup latch mechanism 38, each linkage arm assembly 66 is coupled to the slide lock housing 42 by press fitting the pin 72 into one of the mounting bosses 49 and is also coupled to the sealing member housing 58 by press fitting the pin 70 into one of the mounting bosses 62. In the assembled state, the sealing conduit member 56 is positioned at least partially within the elongated aperture 44 found on the slide lock housing 42. The linkage arm assemblies 66 are positioned at least partially within the L-shaped recesses 46 found on the slide lock housing 42. The L-shaped recesses 46 allow adequate clearance for the linkage arm assemblies 66 and mounting boss 62 protrusions as the dirt cup latch mechanism 38 is cycled through its latched and unlatched positions, which will be described in more detail below.

Figure 4A:
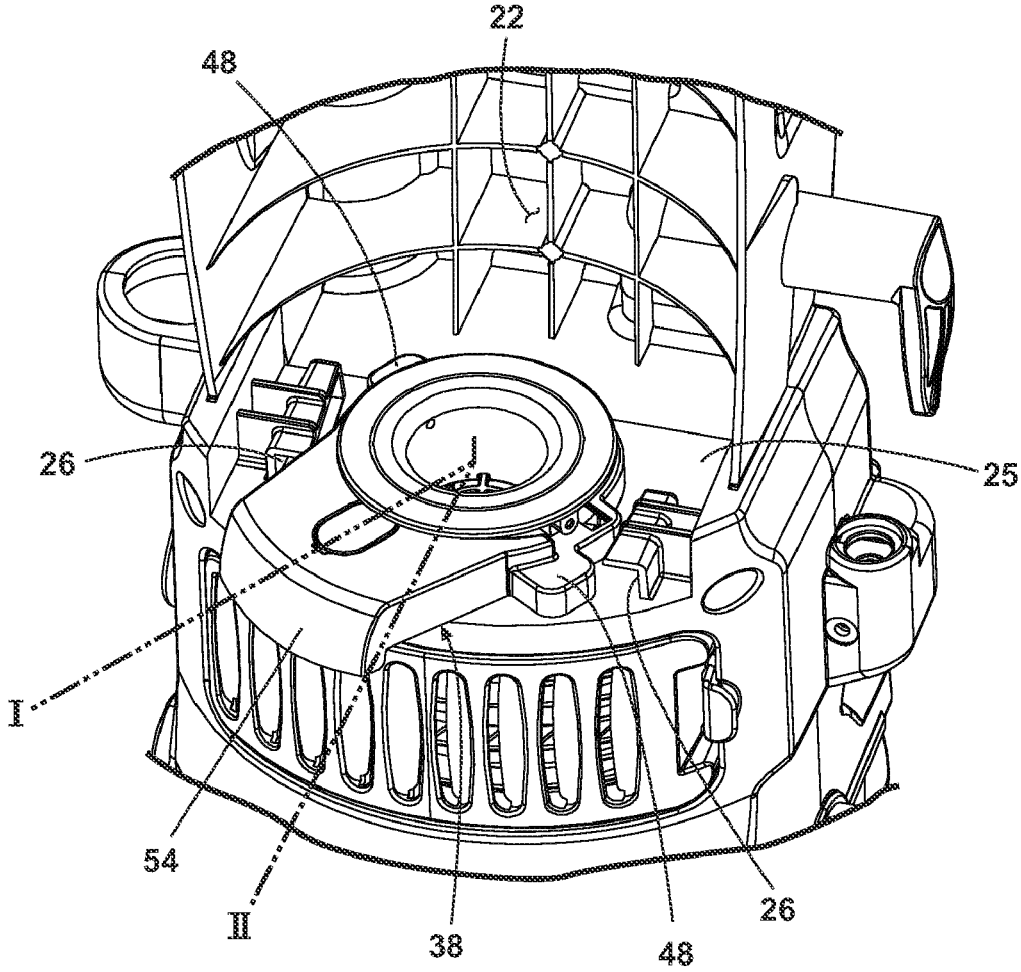
FIG. 4A is a partial front perspective view of the dust cup recess with the latching mechanism in a pre-installation position.
Figure 4B:
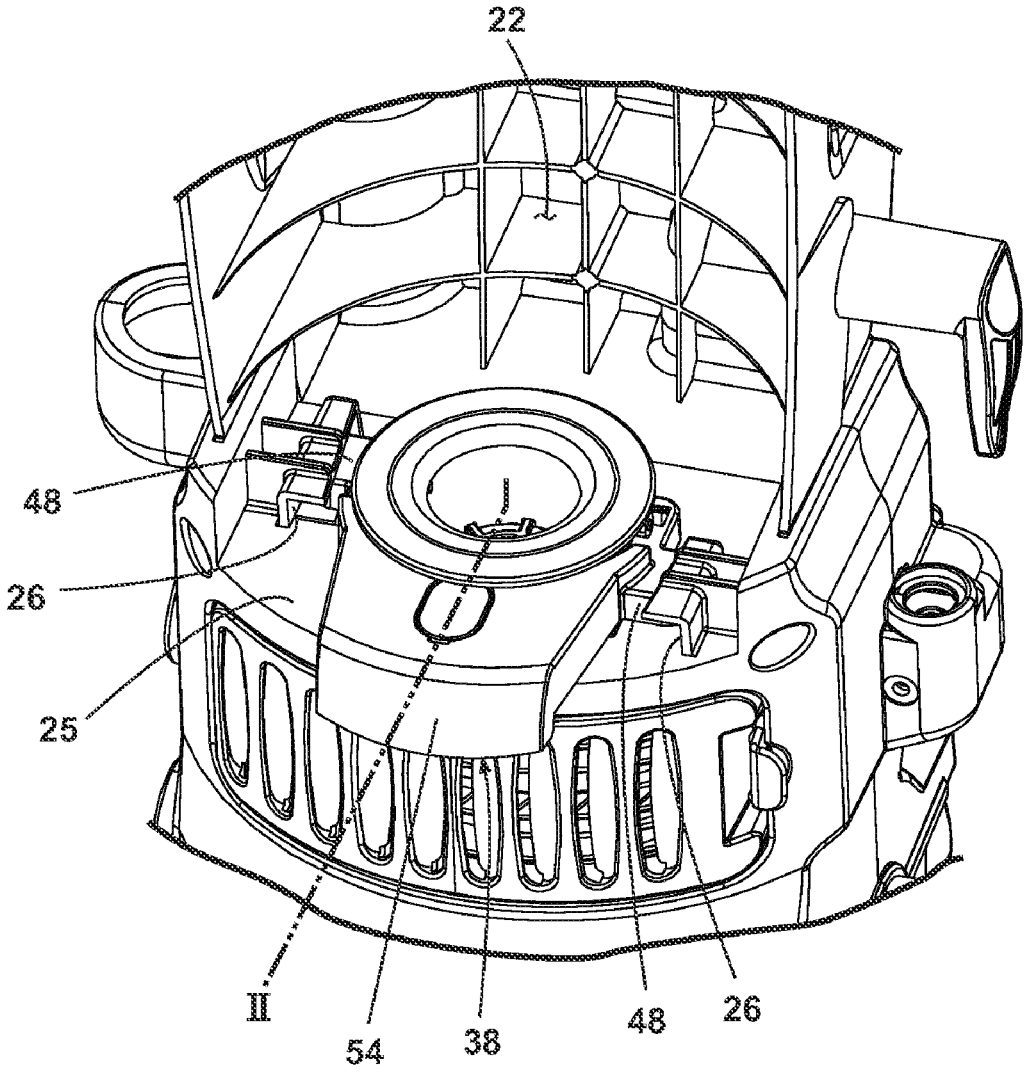
FIG. 4B is a partial front perspective view of the dust cup recess with the latching mechanism in an installed position.

Referring now to FIGS. 4A, and 4B, the installation of the dust cup latch mechanism within the dust cup recess is shown. In the illustrated embodiment, the dust cup latch mechanism 38 is assembled to the upright handle assembly 12 by aligning at least one engagement projection 48 with at least one receiving channel 26 and fitting the elongated aperture 44 around the suction motor/fan inlet conduit 24 such that the sealing conduit member 56 is at least partially received within the suction motor/fan inlet conduit 24, as shown in FIG. 4A. Then the dust cup latch mechanism 38 is rotated to an installed position, shown in FIG. 4B, such that the dust cup latch mechanism 38 is slidably captured by the at least one receiving channel 26. Referring to FIG. 4A, the dust cup latch mechanism 38 is rotated roughly 30 degrees from a reference datum I normal to the rear wheel axis in the pre-installation position to a reference datum II, which corresponds to the installed position. In FIG. 4B, the dust cup latch mechanism 38 is in the installed position with engagement projections 48 slidably captured by the receiving channels 26.

Once installed, the dust cup latch mechanism 38 can be secured using a single mounting screw. The securing aperture 50 located on the top surface of the slide lock housing 42 forms a retention screw slot and mates to a stepped or reduced diameter screw boss that receives a washer head retention screw. The particular washer head mounting arrangement is not germane to the invention and will not be shown or further described herein, suffice it to say that the receiving channels 26 in the bottom wall 25 of the dust cup recess 22, together with the washer head screw mounting arrangement, and securing aperture 50 retain the dust cup latch mechanism 38 while adequately allowing for horizontal sliding movement.

Figure 5:
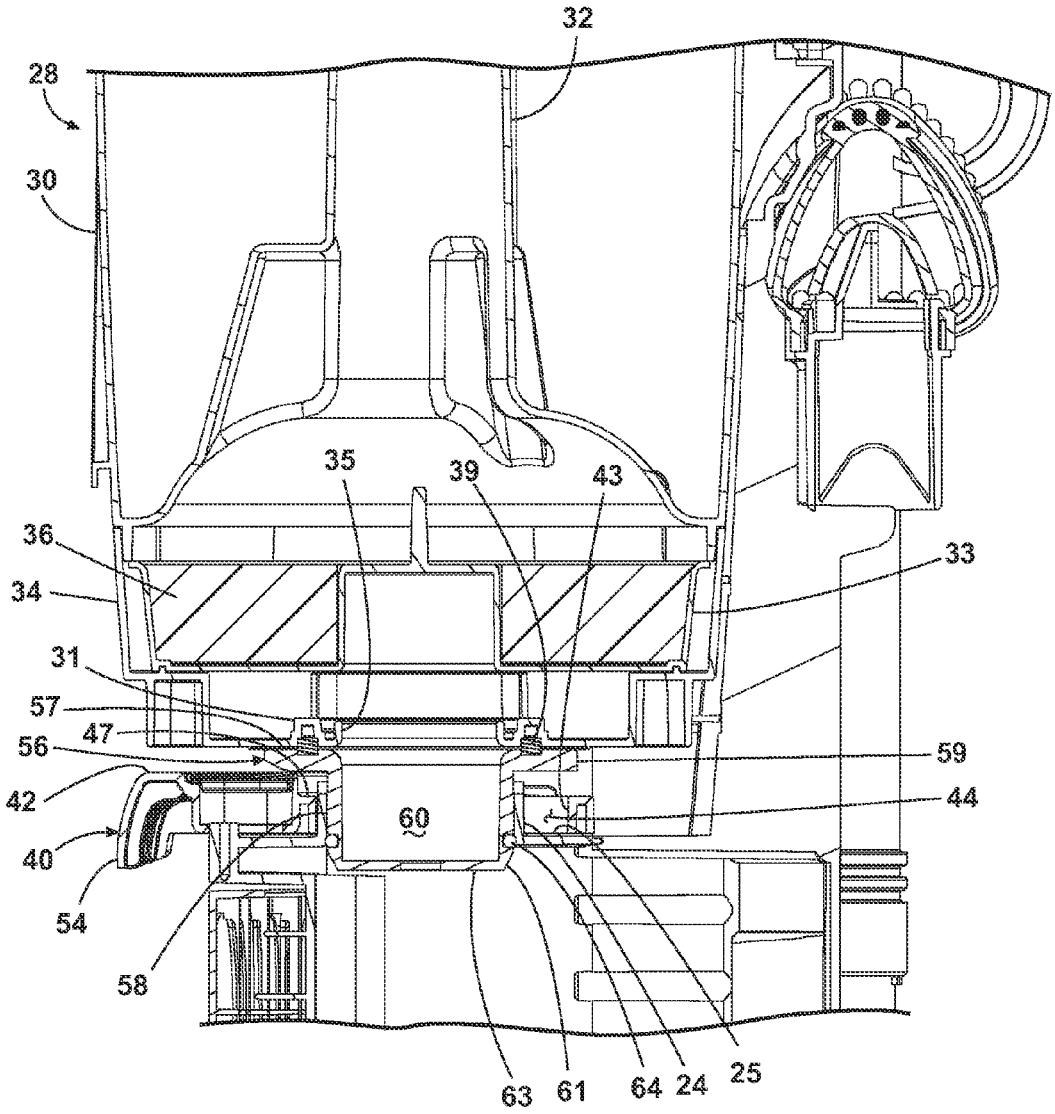
FIG. 5 is a sectional view taken along line 5-5 of FIG. 1 of the latching mechanism in a latched position, in which the latch is engaged and raised.
Figure 6:
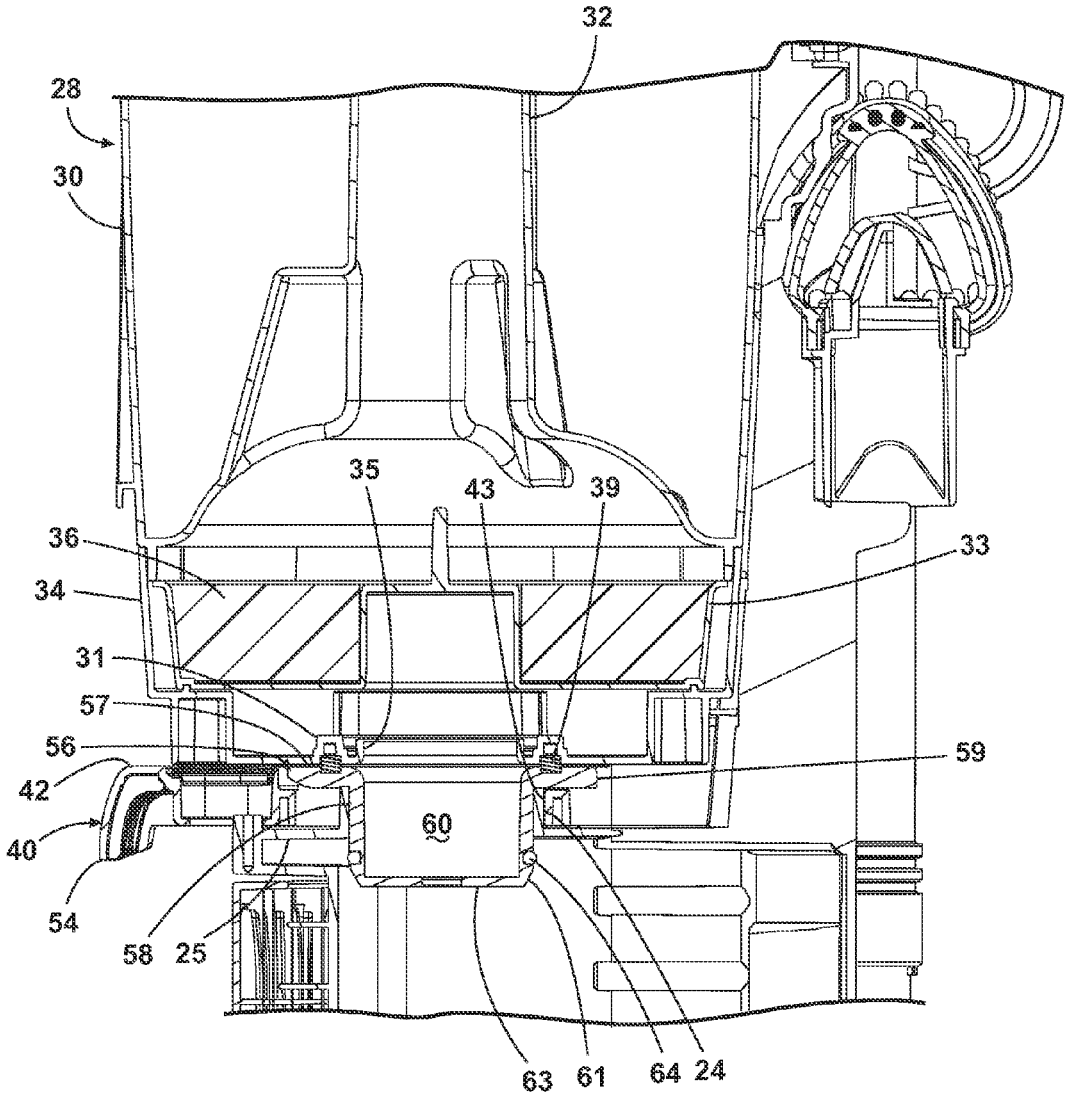
FIG. 6 is a sectional view taken along line 6-6 of FIG. 1 of the latching mechanism in an unlatched position, in which the latch disengaged and lowered.

Referring to FIGS. 2, 5 and 6, the dust cup latch mechanism 38 is mounted to the upright handle assembly 12 such that the slide lock housing 42 is permitted to slide horizontally in and out on the flat bottom wall 25 of the dirt cup recess 22 in a straight path. The grip 54 on the front portion of the slide lock housing 42 allows the user to pull and push the slide lock housing 42 as required and performs in the same functional manner as a drawer pull. The sealing conduit member 56 extends through the suction motor/fan inlet conduit 24 so that the flange 59 rests on the upper edge of the suction motor/fan inlet conduit 24 and the lower portion 61 fits beneath the bottom wall 25 of the dust cup recess 22. The elongated aperture 44 and elongated depression 47 on the top surface of the slide lock housing 42 accommodate the sealing conduit member 56 such that it may move vertically as the slide lock housing 42 moves horizontally. The elongated aperture 44 can be generally oval in shape so that the slide lock housing 42 can move laterally relative to the sealing conduit member 56. The elongated aperture 44 also has clearance for the air passageway 60 within the sealing member housing 58 that fluidly connects the suction motor/fan inlet conduit 24 to the dust cup assembly 28. The two L-shaped recesses 46 have clearance to accommodate rotation of the linkage arm assemblies 66 during latch mechanism use. The outlet end of the center air passage 35 rests on the upper sealing surface 57 of the sealing member housing 58.

FIGS. 5 and 7 show the dust cup latch mechanism 38 in its engaged or latched position, in which the sealing conduit member 56 is raised to its uppermost position, in turn, raising the dust cup assembly 28 to secure the upper end of the dust cup 30 against the bottom end of the of the cyclone separator 20, thereby compressing the seal 39, and sealing ring 64 for efficient vacuum operation with minimal leakage. In the latched position, the sealing surface 57 of the sealing conduit member 56 is pressed against the bottom of the pre-motor filter chamber 34 and the flange 59 rests atop the upper surface of the slide lock housing 42. The dust cup latch mechanism 38 is moved to its latched position by pushing the slide lock latch assembly 40 inward, i.e. towards the rear wall 23 of the dust cup recess 22.

FIGS. 6 and 8 show the dust cup latch mechanism, 38 in its disengaged or unlatched position, in which the sealing conduit member 56 is lowered, which accordingly lowers the dust cup assembly 28 out of engagement with the cyclone separator 20 to rest on the sealing conduit member 56 and the top surface of the slide lock latch assembly 40. The dust cup assembly 28 can then be removed as a unit from the vacuum cleaner 10 by simply lifting/pulling it out of the dust cup recess 22. In the unlatched position, the linkage arm assemblies 66 are rotated towards the rear wall 23 which subsequently forces the sealing conduit member 56 to move downward against the slide lock latch assembly 40, with the flange 59 at least partially received by the elongated depression 47.

The dust cup latch mechanism 38 is moved to its unlatched position by pulling the slide lock latch assembly 40 out from the from the rear wall 23 of the dust cup recess 22 to the limit of its travel. In the illustrated embodiment, the travel distance of the slide lock latch assembly 40 is controlled by the length of the linkage arm assemblies 66 and the securing aperture 50. As the slide lock latch assembly is pulled horizontally, the link pin 72 moves with the slide lock housing 42. The action of the link pin 72 is transmitted to the link pin 70 by virtue of the link member 68; however, because horizontal movement of the sealing conduit member 56 is generally prevented by the suction motor/fan inlet conduit 24, the movement of the sealing conduit member 56 will be almost entirely vertical.

Referring to FIGS. 7 and 8, the dust cup latch mechanism 38 incorporates a natural detent by virtue of the "over-center" pin and linkage arrangement. When in the latched position (FIG. 7), the linkage members 68 rotate slightly beyond vertical such that the linkage arm assemblies 66 and dust cup latch mechanism 38 become naturally retained or locked until the user intentionally releases the dust cup latch mechanism 38 by pulling the slide lock latch assembly 40 outward to move to the unlatched position (FIG. 8). The locking action of the "over-center" pin and linkage arrangement is also aided by the compressed seal 39, which tends force the dust cup assembly 28 away from the sealing conduit member 56 in the latched position, thereby naturally tending to rotating the linkage arm assemblies 66 to a position in which the linkage members 68 are not vertical.

It will be understood that the disclosed embodiments are representative of presently preferred forms of the invention, but, are intended to be illustrative rather than definitive of the invention. The illustrated upright vacuum cleaner is but one example of the variety of cyclone-separating type vacuum cleaners with which this invention or some slight variant can be used. Reasonable variation and modification are possible within the forgoing disclosure and drawings without departing from the scope of the invention which is defined by the appended claims.

What is claimed is:

1. A vacuum cleaner comprising:

a housing with a cyclone separation chamber having an inlet opening and an outlet opening;

a dust cup assembly removably mounted beneath the cyclone separation chamber and having a dust cup with an exhaust conduit extending through the dust cup between the cyclone separation outlet opening and a discharge opening in a bottom wall of the dust cup; and a latching mechanism positioned beneath the dust cup assembly for raising the dust cup into engagement with the cyclone separation chamber and for lowering the dust cup from engagement with the cyclone chamber, and comprising;

a sealing conduit member mounted in the housing beneath the dust cup assembly in fluid communication with the exhaust conduit when the dust cup is in engagement with the cyclone separation chamber; and a sliding latch member coupled to the sealing conduit member via at least one linkage member and being movable relative to the housing to raise and lower the sealing conduit member into and out of engagement with the dust cup assembly.

2. The vacuum cleaner of claim 1, and further comprising a suction source having an inlet opening in fluid communication with the sealing conduit member.

3. The vacuum cleaner of claim 2 wherein the sealing conduit member further comprises a first seal that is positioned between the sealing conduit member and the inlet opening of the suction source when the sealing conduit member is in engagement with the dust cup assembly.

4. The vacuum cleaner of claim 2 wherein the dust cup assembly further comprises a filter chamber having a filter mounted therein in fluid communication between the dust cup discharge opening and the inlet opening of the suction source, the filter chamber being removably mounted to the dust cup.

5. The vacuum cleaner of claim 4 wherein the filter chamber comprises a seal that is positioned between the sealing conduit member and the filter chamber when the sealing conduit member is in engagement with the dust cup assembly.

6. The vacuum cleaner of claim 1 wherein the latching mechanism comprises at least one engagement projection that corresponds to at least one receiving channel in the housing.

7. The vacuum cleaner of claim 6 wherein the at least one receiving channel is offset relative to the at least one engagement projection such that the latching mechanism is assembled by aligning the at least one engagement projection with the at least one receiving channel and then rotating the latching mechanism to the use position such that the at least one engagement projection is slidably captured by the at least one receiving channel.

8. The vacuum cleaner of claim 7 and further comprising a pair of opposed receiving channels in the housing and a pair of corresponding engagement projections on the sliding latch member, wherein the engagement projections are offset with respect to one another.

9. The vacuum cleaner of claim 1 wherein the at least one linkage member is configured to translate horizontal sliding movement of the sliding latch member to vertical movement of the sealing conduit member.

10. The vacuum cleaner of claim 1 wherein the at least one linkage member comprises an elongated piece having two spaced link pins, with the first link pin connected to the sealing conduit member and the second link pin connected to the sliding latch member.

11. The vacuum cleaner of claim 10 wherein the at least one linkage member moves to an over-center position to secure the sealing conduit member in engagement with the dust cup assembly.

* * * * *